United States Patent [19]

Hatfield

[11] 4,288,908

[45] Sep. 15, 1981

[54] CABLE CLAMPING AND ORIENTING APPARATUS

[75] Inventor: John G. Hatfield, Camp Hill, Pa.

[73] Assignee: AMP Incorporated, Harrisburg, Pa.

[21] Appl. No.: 88,691

[22] Filed: Oct. 26, 1979

[51] Int. Cl.[3] ..... H01R 43/04

[52] U.S. Cl. ..... 29/564.1; 29/56.6; 29/759

[58] Field of Search ..... 29/56.6, 759, 749, 33 M, 29/564, 564.1, 566

[56] References Cited

U.S. PATENT DOCUMENTS

| | | | |
|---|---|---|---|
| 3,742,571 | 7/1973 | Brehm | 29/56.6 |
| 3,769,681 | 11/1973 | Eubanks | 29/759 X |
| 3,791,008 | 2/1974 | Dyksterhouse | 29/56.6 |
| 3,810,289 | 5/1974 | Hannaberry | 29/749 X |
| 3,816,897 | 6/1974 | Long | 29/56.6 |
| 3,845,523 | 11/1974 | Mayberry | 24/134 P |
| 3,965,558 | 6/1976 | McKee | 29/749 |
| 3,968,548 | 7/1976 | Clark | 29/759 X |
| 4,006,519 | 2/1977 | Long et al. | 29/749 |
| 4,020,540 | 5/1977 | Casciotti et al. | 29/749 |
| 4,034,472 | 7/1977 | Cover et al. | 29/749 |
| 4,043,017 | 8/1977 | Folic et al. | 29/759 X |
| 4,193,187 | 3/1980 | Haller | 29/759 X |

*Primary Examiner*—William R. Briggs
*Attorney, Agent, or Firm*—Gerald K. Kita

[57] ABSTRACT

A clamp is disclosed for use during connection of insulated wires into an electrical connector. The wires are collectively provided by an electrical cable which must be orientated by the clamp to project perpendicular to the connector when all the wires are connected.

7 Claims, 10 Drawing Figures

CABLE CLAMPING AND ORIENTING APPARATUS

FIELD OF THE INVENTION

The present invention relates to automated termination of multiple electrical wires of a multiwire cable in an electrical connector. Apparatus is disclosed which orients the cable during termination of its wires, so that when all terminations are completed, the cable will be closely proximate the connector and will project at a desired angle from the connector.

BACKGROUND OF THE INVENTION

An electrical connector for terminating multiple conductor electrical cable is disclosed in U.S. Pat. No. 3,760,335, and includes two parallel rows of electrical contacts. The contacts of a plug version of the connector resiliently engage those of a receptacle version, when the two versions are intermated. The contacts of each version have wire receiving and connecting portions, each in the form of a resilient plate provided with a slot. An insulted conductor of the cable is trimmed to length and inserted in the slot. The conductor tends to widen the slot. Since the plate is resilient, the sides of the slot provide resilient jaws which resist widening of the slot. As a result, the jaws slice through the insulation of the conductor and resiliently engage opposite sides of the wire.

Suitable apparatus have been developed for trimming and inserting the conductors into the connector contacts, as disclosed in U.S. Pat. Nos. 3,803,695; 3,864,802; and 3,995,358. Each disclosed apparatus requires an operator to grasp a pair of conductors and insert them into the apparatus. Then the apparatus is actuated, either manually or automatically, to trim the conductor and transfer the trimmed wires into the connector. One type of apparatus requires all conductor pairs to be placed in the apparatus, followed by simultaneous or mass termination of the conductors in the connector contacts. A second type senses each pair of conductors and thereby is automatically triggered to trim and insert the pair into a corresponding pair of connector contacts. While an operator is in the process of selecting and grasping the next pair of conductors, the apparatus of the second type has automatically moved, relative to the connector, in registration with the next pair of connector contacts into which the next pair of conductors will be inserted.

Each type of conductor trimming and inserting apparatus requires a clamp for anchoring the cable to the apparatus while the conductor terminations occur. The clamp is positioned out of the way of the operator and the working parts of the apparatus. While this clamp location is convenient to the operation of the apparatus, the clamp may force the cable to project in a peculiar or undesired direction in respect to the connector to which it becomes assembled.

SUMMARY OF THE INVENTION

The present invention resides in a cable clamp which is used in conjunction with conductor trimming and inserting apparatus. As opposed to prior clamps, which are fixed, the present clamp is moveable to orient the clamped cable at a desired angle relative the connector in which the cable conductors are terminated. The mechanism for moving the clamp is coupled to the wire trimming and inserting apparatus, so that incremental movement of the apparatus along the connector causes corresponding incremental movement of the cable clamp. By allowing only increments of movement, the cable and the clamp remain out of the way during wire termination. Direct coupling of the clamp and the trimming and inserting apparatus eliminates the need for a separate drive to move the clamp.

OBJECTS

An object of the present invention is to provide a cable clamp which directs a cable to a desired position while the conductors of the cable are being trimmed and inserted in an electrical connector.

Another object is to provide wire trimming and inserting apparatus with a cable clamp, moveable together with the apparatus, to orient a clamped electrical cable, so that the cable projects in a desired direction from an electrical connector in which the insulated conductors of the cable are trimmed and inserted.

Another object is to couple a cable clamp with a wire trimming and inserting apparatus which moves serially along an electrical connector while trimming and inserting conductors of a cable, the clamp securing the cable and being actuated by movement of the apparatus to direct the cable in a desired orientation in respect to the electrical connector.

Other objects and advantages of the present invention will become apparent from the following detailed description taken in conjunction with the accompanying drawings.

DRAWINGS

DETAILED DESCRIPTION

Figure 1:
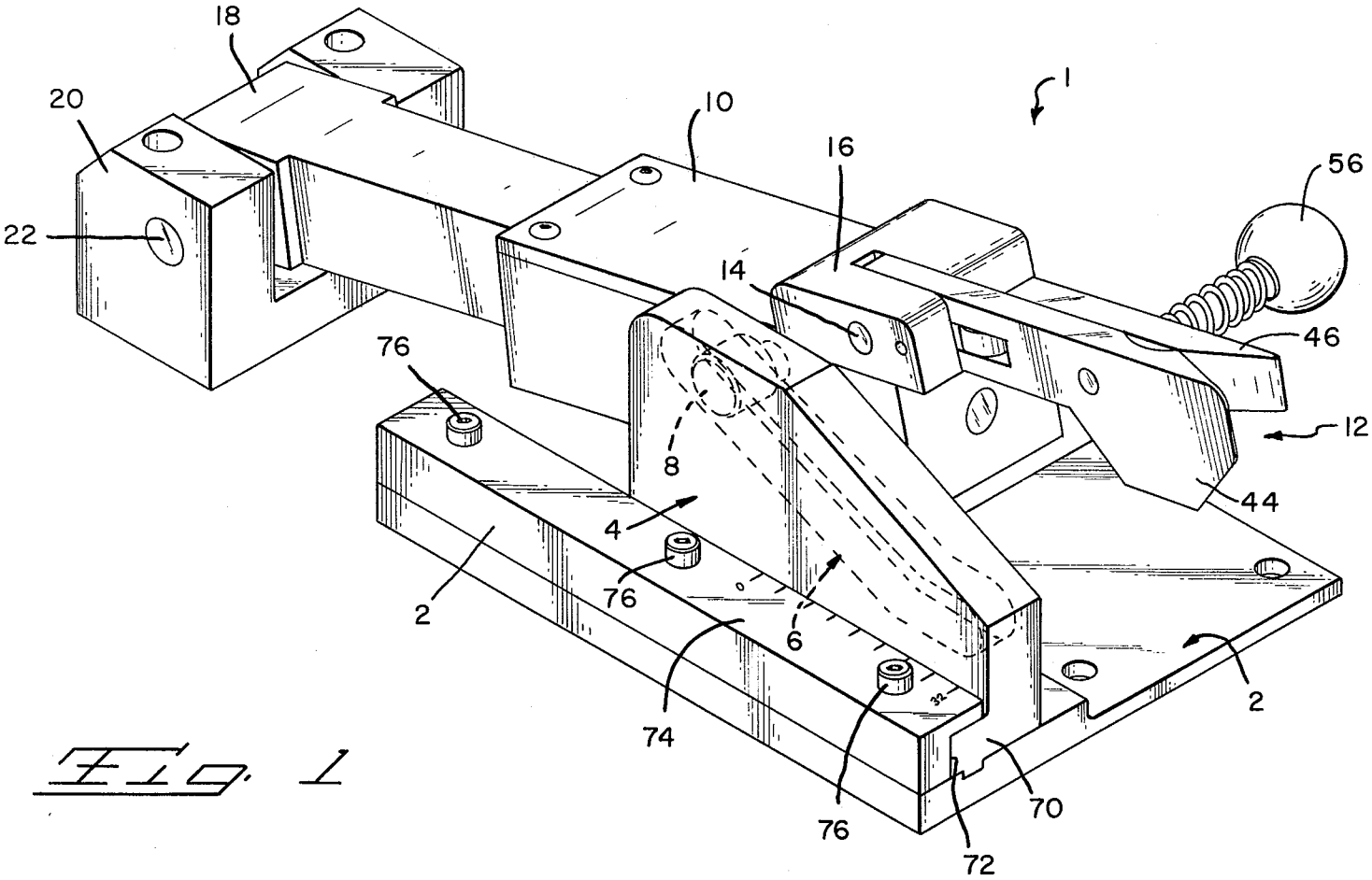
FIG. 1 is a perspective of a cable directing clamp, as a preferred embodiment.

FIG. 1 more particularly shows a cable clamping and orienting mechanism or apparatus 1 comprising a base 2 on which is mounted a cam plate 4 machined with a cam slot or groove 6 in the thickness of the plate. A roller follower 8, adapted for displacement along the slot 6, projects from an elongated arm 10, at one end of which is a cable grip or clamp 12 pivotally mounted by a pin 14 which passes through the clamp 12 and a slotted clevis 16 on the end of the arm 10. The opposite end 18 of the arm 10 is mounted in a slotted, enlarged clevis 20 and is pivotable on a pin 22 which passes through the end 18 and is mounted by the clevis 20.

Figure 2:
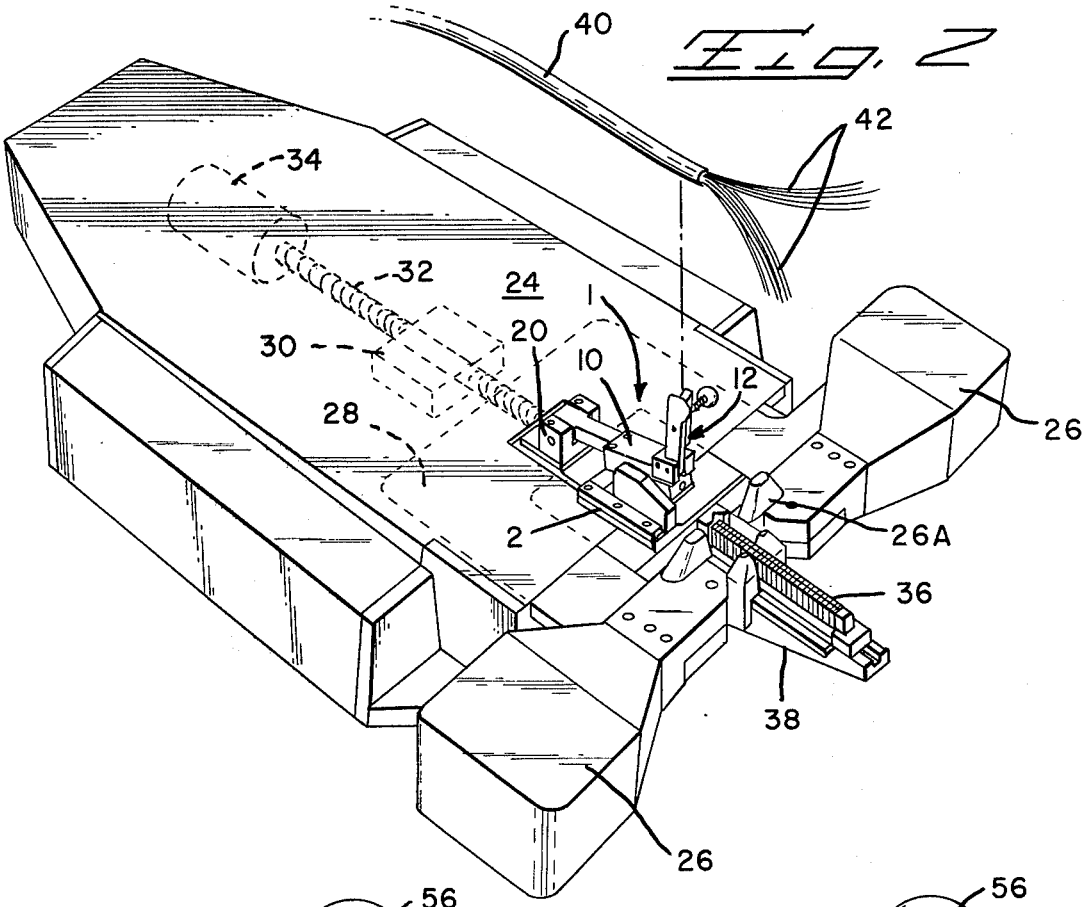
FIG. 2 is a reduced perspective of the clamp, shown in FIG. 1, coupled to a wire trimming and inserting apparatus.

The mechanism 1 is shown in FIG. 2 mounted on a wire trimming and inserting apparatus 24 including a frame and being of the type in which a pair of wire trimming and inserting mechanisms 26 are mounted on a common carriage 28 in the form of a U-shaped yoke. The yoke is removably secured to an internally threaded drive block 30 which meshes with an elongated worm gear drive shaft 32 coupled to the output shaft of an electrically driven stepping motor 34. The precise increment of rotation of the motor 34 will advance the yoke 28 an increment of displacement along the axis of the worm gear 32. The mechanisms 26 will be incrementally advanced lengthwise of and along the opposite sides of an electrical connector 36 mounted removably on an anvil 38 mounted on the frame between the mechanisms 26.

The mechanisms 26 are serially advanced along the length of the connector in successive increments of displacement corresponding to successive wire receiving and connecting electrical contacts along the opposite sides of the connector 36. An electrical cable 40 having multiple pairs of insulated wire conductors 42 are adapted for electrical connection to the rows of contacts in the connector 36. An operator selects a pair of conductors 42, which are color coded for identification, and presents them to the mechanisms 26. The pair of conductors are sensed, and the mechanisms 26 then are actuated to trim the presented conductors to desired lengths and insert them into corresponding connector contacts, one in each row of contacts. The mechanisms are then incrementally displaced or advanced to the next pair of contacts in which additional conductors 42 are to be connected. Further details of the apparatus 24 are contained in U.S. Pat. No. 4,238,874 Ser. No. 929,742, filed July 31, 1978.

The apparatus 1 is actuated by the incremental displacement of the yoke 28 by the motor 34. More particularly, the base 2 is mounted fixedly on the frame of apparatus 24. The clevis 20 is mounted on the yoke 28 for movement therewith by the motor 34.

Figure 3:
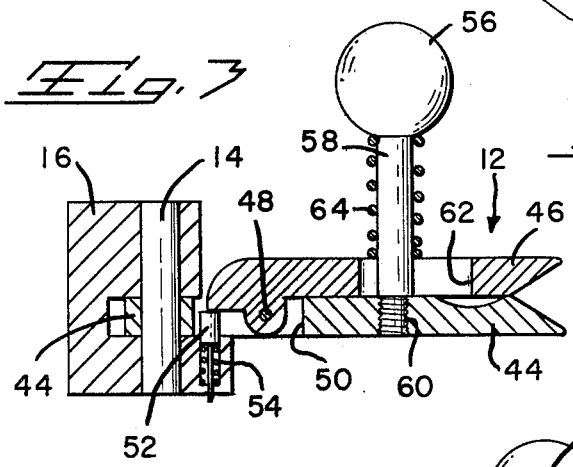
FIGS. 3, 4 and 5 are enlarged plan views in section of a cable gripping portion of the clamp, illustrating its operation.
Figure 4:
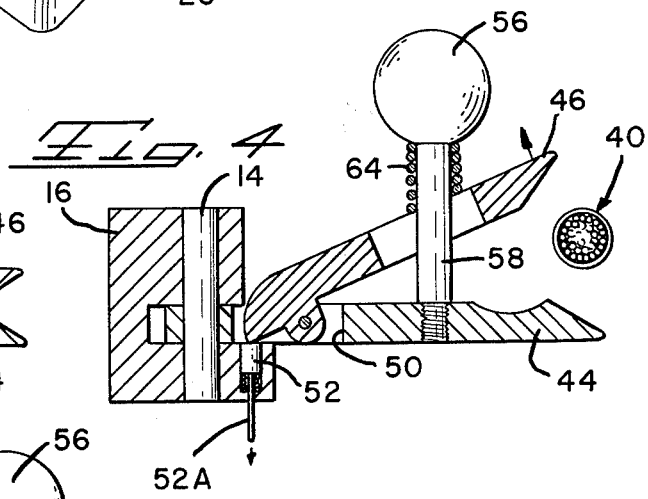
Figure 5:
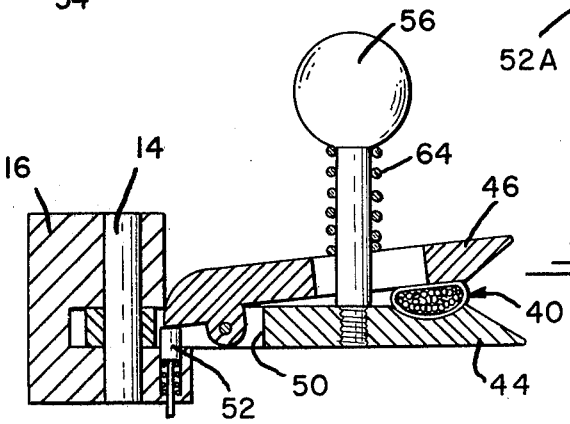

The details of the clamp 12 are shown in FIGS. 3–5. The clamp includes a pair of cable gripping fingers 44 and 46, with the latter pivotally connected by a pin 48 to the finger 44, which includes a slot 50 in which is disposed the pivot connection by the pin 48. One end of the finger 44 enters the slotted clevis 20 and is pivotally connected to the clevis by the pin 14. The clevis is provided with a plunger member 52, urged by a coil spring 54, mounted in a recess in the clevis 16, to project into the slot 50 of the finger 44 and engage the end of the finger 46. A knob 56 is on the end of a shaft 58 which is threadably secured at 60 in the finger 44. The finger 46 has a slot 62 through which the shaft 58 freely projects. A coil spring 64 encircles the shaft 58 and is in compression between the knob 56 and the finger 46 to engage and urge the latter toward the finger 44 to grip the cable 40 therebetween.

FIG. 4 shows the fingers 44 and 46 pivoted apart, with the plunger 52 being pushed out of the slot 50 by the finger 46. With the plunger removed from the slot 50, the clamp may be pivoted about the pin 74 to a vertical position as shown in FIG. 2. The plunger 52 also may be removed from the slot 50 by pulling on the projecting stem 52A. The fingers 44 and 46 project vertically upward out of the way of the mechanisms 26, and enable placement of the connector 36 on the anvil 38. Further, the cable 40 is readily inserted, vertically downward, between the fingers 44 and 46, and clamped thereby.

Once the cable 40 is clamped, the clamp 12 can be pivoted to its position as shown in FIGS. 3 and 5, with the latter Figure showing the cable 40 clamped between the fingers 44 and 46, and the plunger 52 entering the slot 50 to fix the clamp 12 on the arm 10 and prevent pivoting of the clamp 12 until the fingers 44 and 46 are pivoted apart to remove the clamped cable 40.

Figure 6:
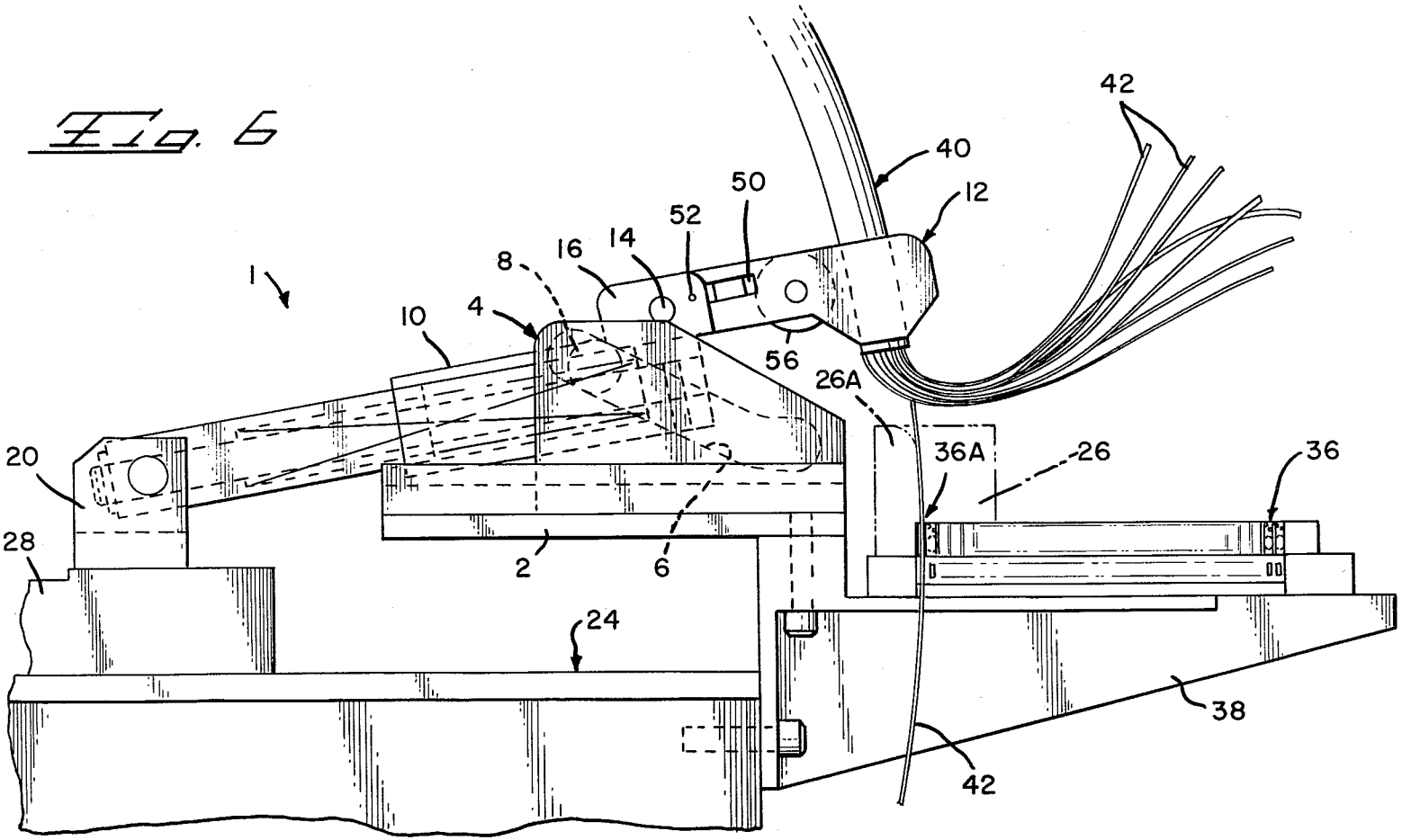
FIG. 6 is an enlarged fragmentary elevation of the cable clamp and a portion of the wire trimming and inserting apparatus.

FIG. 6 shows the position of the clamped cable 40 in readiness to begin termination of the cable conductors 42 in the contacts of the connector 36. A first pair of conductors 42 (one shown) is presented by an operator into the mechanisms 26, with each conductor against a guide anvil 26A which positions the conductor in alignment with the wire receiving slot of the first contact 36A of the connector 36. Each conductor of the presented pair is sensed, and then trimmed and inserted into the contact 36A by the corresponding mechanism 26. In this manner, the conductors are terminated by the connector contacts. Then the yoke 28, together with the mechanisms 26, are advanced incrementally to the next contacts adjacent the contacts 36A. Movement of the yoke will advance the clevis 20 with the base 2 fixed, urging the arm 10 to pivot as controlled by the path of the follower 8 along the slot cam 6. As shown in FIG. 6, the slot 6 will force the clamp on the arm to pivot clockwise toward the connector 36, and also from left to right, along the connector length and overlying the longitudinal axis of the connector. At all times during termination of the conductors 42 in the connector contacts, the clamp 12 will remain out of the way even as it is advanced toward and along the connector 36.

Figures 7, 8:
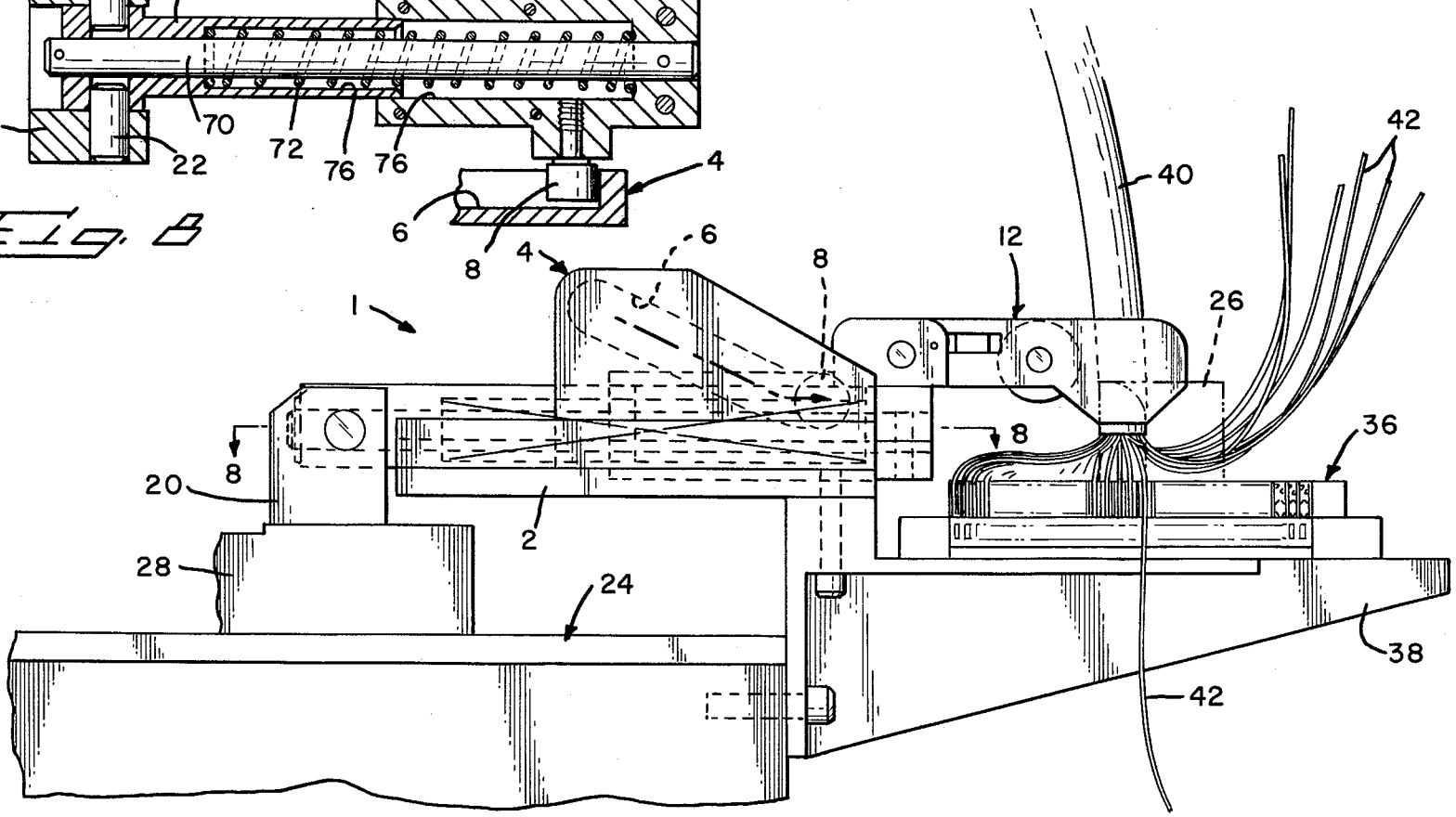
FIG. 7 is a view similar to FIG. 6, illustrating actuation of the cable directing function of the clamp in response to movement of the wire trimming and inserting apparatus.
FIG. 8 is a longitudinal section of a collapsible telescoping section of an arm portion of the clamp.

FIG. 7 shows the follower 8 at the end of the cam slot 6, when the cable 40 can be advanced by the clamp along the connector to the midlength or center of the connector 36 and be pivoted by the clamp to project perpendicular to and closely proximate the connector, without interfering with insertion of the conductors 42 in the connector contacts. The remaining cable conductors 42 may be terminated without interference by the cable 40 or clamp 12.

Figure 9:
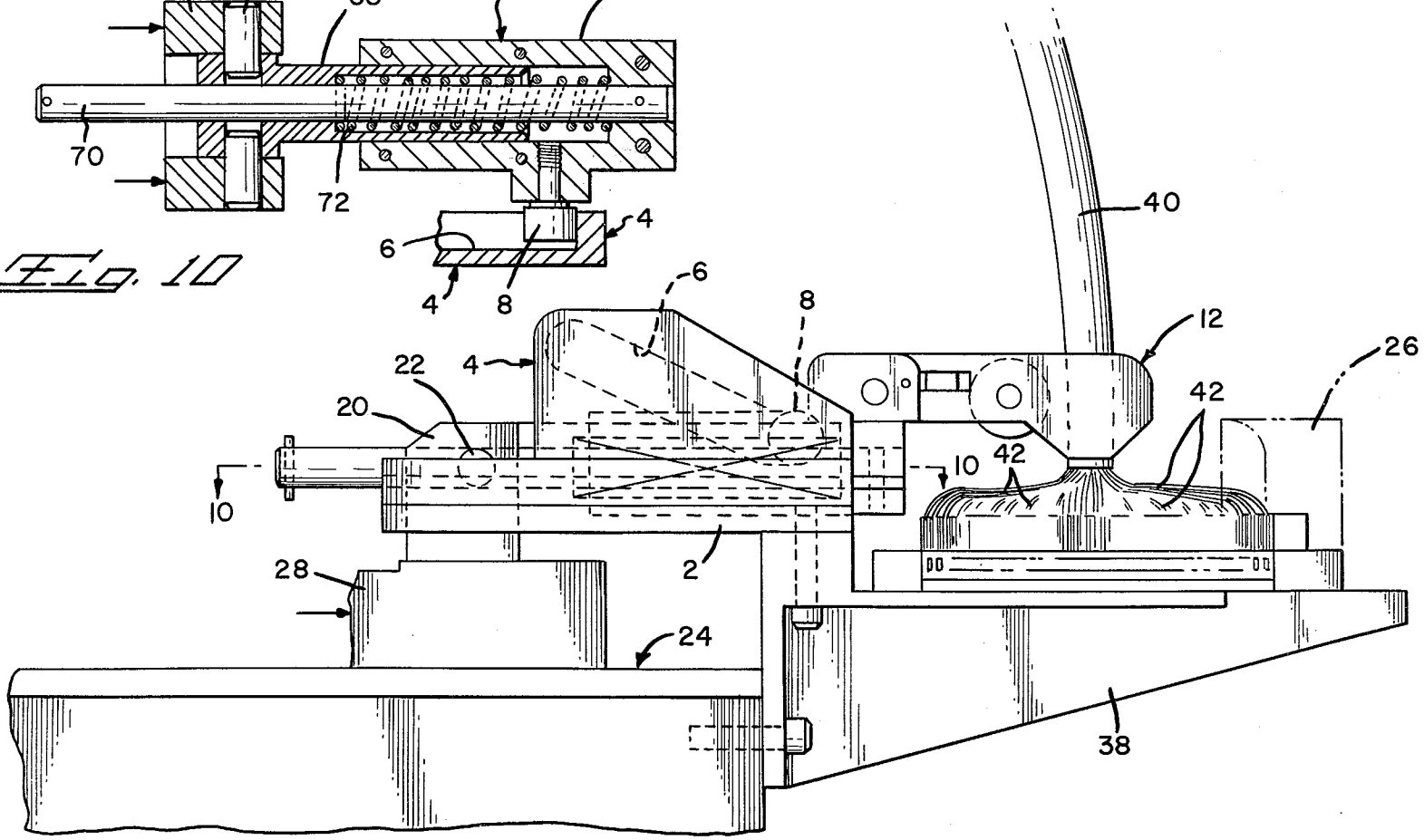
FIG. 9 is a view similar to FIG. 7 illustrating telescoped collapse of the arm as a result of movement by the wire trimming and inserting apparatus.

FIG. 9 shows all the conductors 42 of the cable 40 terminated in the connector contacts. The cable 40 remains in the same position as shown in FIG. 7, with the follower 8 remaining at the end of the cam slot 6. However, the yoke 28 must continue incremental advances for termination of the remainder of conductors 42 while the clamp 12 remains in place. Accordingly, the arm 10 is collapsible to permit movement of the clevis 20 with the yoke 28 and toward the clamp 12 with the base 2 stationary.

FIG. 8 shows the arm 10 constructed with an outer sleeve section 66 in which is telescoped an inner sleeve section 68. A rod 70 is concentric with both sleeve sections and is encircled by a coil spring 72 contained in mutually communicating recesses 74 and 76 axially in the sleeve sections. The ends of the spring engage against the bottoms of the recesses to urge the telescoping sections outwardly lengthwise of each other.

Figure 10:
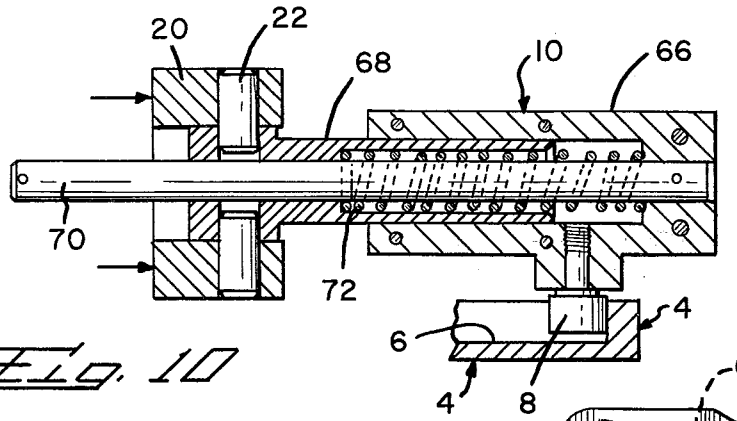
FIG. 10 is a longitudinal section similar to FIG. 8 of a collapsible telescoping section of an arm portion of a clamp in a collapsed position.

FIG. 10 shows telescoping collapse of the sleeve sections 66 and 68, compressing the spring 72 as the clevis 20 moves with the yoke 28, while the follower 8 is stopped at the end of the cam slot 6. By constructing the slot 6 with a selected suitable configuration the cable 40 may be directed automatically to the desired orientation with respect to the connector. When the conductor terminations have been completed, the assembly of the cable and connector may be removed from the clamp 12 and apparatus 24.

FIG. 1 shows that the plate 4 has an L-shaped cross section to define a key 70 slidable along a keyway 72 defined along the base 2 and along an undercut mounting block 74. The plate 4 is adjustable along the keyway 72 and secured by cap screws 76. This adjustment will position the end of the cam slot 6 so that the follower 8 will stop at a desired point relative to the length of the connector 36. The clamp thereby will orient a cable at a desired point along the length of the connector 36. If a shorter connector is to be used, the effective length of the slot 6 can be shortened by adjustment of the plate 4.

Although a preferred embodiment of the present invention has been described and shown in detail, other modifications and embodiments which would be apparent to one having ordinary skill in the art are intended to be covered by the spirit and scope of the claims.

What is claimed is:

1. Apparatus comprising a frame mounting a holder for an electrical connector, indexing means, a wire connecting mechanism linked to said indexing means for indexed traverse in respect to said connector and successive indexed alignment with terminals of said connector, said wire connecting mechanism being operative for connecting individual wires with respective said terminals, and a cable clamp movable with said wire connecting mechanism for holding a multiple wire cable during connection of the individual wires thereof with said terminals, characterized in that said clamp and said frame are linked by cam means for moving said clamp and said cable held thereby relative longitudinally and transversely of said connector during said traverse of said wire connecting mechanism.

2. Apparatus as recited in claim 1, characterized in that said cam means comprises a guide cam interengaged with a cam follower for traverse along said guide cam, said clamp and said cam follower are mounted on a link arm, and a pivotal connection is provided between said link arm and said wire connecting mechanism.

3. Apparatus as recited in claim 2, characterized in that said link arm is contractible.

4. Apparatus as recited in claim 2, characterized in that said cam means includes stop means for limiting traverse of said cam follower along said cam means, and said link arm is contractible with said cam follower engaged against said stop means during said traverse of said wire connecting mechanism.

5. Apparatus as recited in claim 2, characterized in that said cam means is so constructed and arranged for moving said clamp along an arcuate path of traverse to a position midway along a length of said connector in response to said traverse of said wire connecting mechanism.

6. Apparatus as recited in claim 5, characterized in that said cam means is adjustably located and secured on said frame to adjust said path of traverse.

7. Apparatus as recited in claim 1, characterized in that said cam means is so constructed and arranged for moving said clamp and said cable held thereby along an arcuate path of traverse to a position midway along a length of said connector in response to said traverse of said wire connecting mechanism.

* * * * *